United States Patent [19]

Hall et al.

[11] Patent Number: 4,744,766

[45] Date of Patent: May 17, 1988

[54] LOW VOLTAGE ELECTRICAL DISTRIBUTION SYSTEM

[75] Inventors: Stephen Hall; David S. B. Clarke, both of London; Michael D. Thompson, Little Hellingbury, all of England

[73] Assignee: Light Source Electrical Equipment Limited, Great Britain

[21] Appl. No.: 8,697

[22] Filed: Jan. 29, 1987

[30] Foreign Application Priority Data

Jan. 29, 1986 [GB] United Kingdom ..... 8602200

[51] Int. Cl.[4] ..... H01R 13/60

[52] U.S. Cl. ..... 439/110

[58] Field of Search ..... 439/110, 116, 118, 121, 439/391, 393, 425, 426

[56] References Cited

U.S. PATENT DOCUMENTS 3,383,641 5/1968 Piel ..... 439/426

3,527,933 9/1970 Thummel ..... 439/113

*Primary Examiner*—Joseph H. McGlynn

*Attorney, Agent, or Firm*—Leydig, Voit & Mayer, Ltd.

[57] ABSTRACT

A distribution bus 12 comprises a conductor sheet 16 and another electrode 18 separated by an insulating sheet 20 of foamed plastic or foamed glass, or by air.

A jack plug 14 can be plugged in anywhere on the bus 12 by poking a contact pin 44 through a hole 64 in the conductor sheet 16 to contact the other electrode 18, and poking a contact sleeve 46 through the same hole 64 to contact the conductor sheet 16. The jack plug 14 is clipped to the bus 12 by clips 62 which are pushed through other holes 64 in conductor sheet 16 and are cammed by a rotatable wheel 28 into operative position.

25 Claims, 4 Drawing Sheets

LOW VOLTAGE ELECTRICAL DISTRIBUTION SYSTEM

BACKGROUND OF THE INVENTION

Field of the Invention

This invention relates to a low voltage electrical distribution system. By "low voltage" is meant 50 volts or less.

SUMMARY OF THE INVENTION

It is an object of the invention to provide a low voltage electrical distribution system in which power can be tapped at any desired place over a considerable distance or surface area, for use for example in shop window display illumination.

According to the invention there is provided a low voltage electrical distribution system comprising a distribution bus and a jack plug, the distribution bus comprising two electrodes supplied or adapted to be supplied with low voltage electricity therebetween, at least one of the electrodes being in the form of a sheet providing a substantial number of alternate positions over one surface of the sheet for the jack plug to be plugged into the distribution bus at any selected one of said positions to make electrical contact with both electrodes.

DESCRIPTION OF THE PREFERRED EMBODIMENTS

Figure 1:
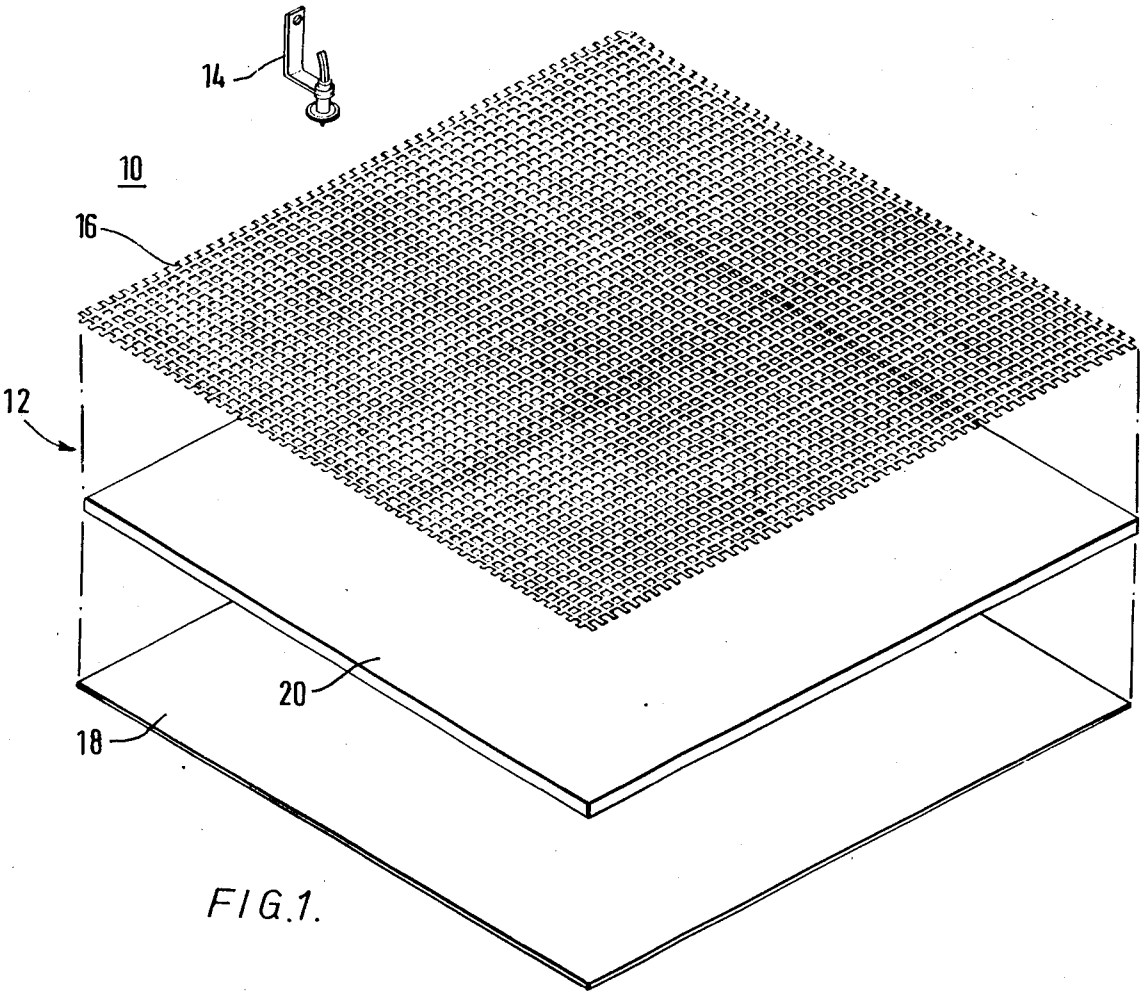
FIG. 1 illustrates a low voltage electrical distribution system embodying the invention, showing a distribution bus and a jack plug, the sheets of the distribution bus being shown exploded.

Referring to FIGS. 1 to 5 of the drawings, there is illustrated a low voltage electrical distribution system 10 which comprises a distribution bus 12 and a jack plug 14.

The distribution bus 12 is formed by a lamination of a front sheet electrode 16 and rear sheet electrode 18 of electrically conductive material (for example, copper or aluminium) separated by a sheet 20 of electrically insulating material (for example foamed plastic or foamed glass) and supplied or adapted to be supplied (by means not shown) with low voltage electricity, that is, 50 volts or less.

The jack plug 14 comprises an insulating holder 22 (in two halves 22/1 and 22/2) an electrical contact assembly 24, a generally disc-like member 26 and a rotatable thumb-wheel 28.

The insulating holder 22 comprises a generally cylindrical hub 30 (formed by hub halves 30/1 and 30/2) at the front end of which is a disc-like flange 32 formed by flange halves 32/1, 32/2. A hub 34, formed by hub halves 34/1, 34/2, projects forwardly of flange 32 and has a forwardly tapering frusto-conical portion 36 (parts 36/1, 36/2) behind which is a reduced diameter neck 38 (38/1, 38/2).

About two thirds along the hub 30 from the flange 32 is an external flange 40 (40/1, 40/2) and, just forwardly of that, internal flange portions 42.

Figure 3:
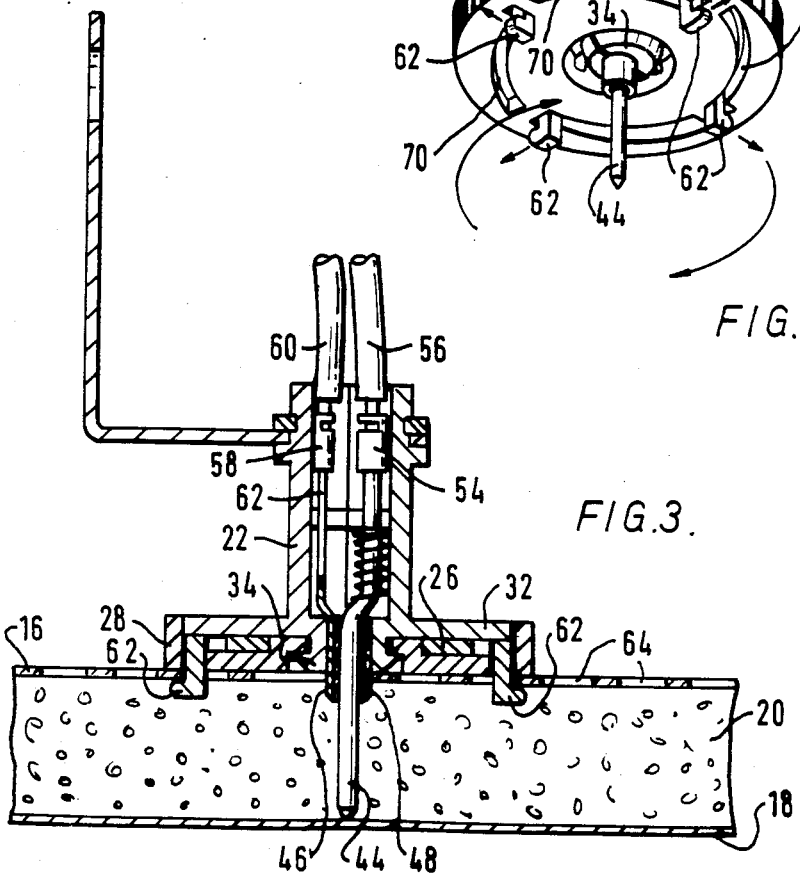
FIG. 3 is a sectional view illustrating the jack plug engaged with the distribution bus.

The electrical contact assembly 24 comprises an electrical contact pin 44 and an electrical contact sleeve 46 which may be of brass. The pin 44 is slidingly received in the sleeve 46 and is electrically insulateld therefrom by an insulating sleeve 48. The pin 44 is cranked at 44*a* and its rearward end portion 44*b* carries a compression spring 50 and washer 52, acting between the cranked pin portion 44*a* and the internal hub flange portion 42 of the insulating holder 22, to bias the pin 44 forwardly of the holder 22, so that it makes good contact with the rear conductor sheet 18 (FIG. 3).

A crimped ferrule 54 electrically connects an insulation sheathed wire 56 in well known manner to pin portion 44*b*. A crimped ferrule 58 similarly connects another insulation sheathed wire 60 to a metal post or tab 62 which is integral with the contact sleeve 46. The contact sleeve 46 is longitudinally slit so as to be resilient for purposes of making good electrical contact with the front conductor sheet 16 (FIG. 3).

In order to make the jack plug 14 self-securing, it is adapted to clip itself to the distribution bus 12 by means of four clips 62 which clip into holes 64 in the front conductor sheet 16. These clips 62 are integral parts of the disc-like member 26, which is seated on the flange 32 of holder 22 and is keyed non-rotatably with holder 22 by conventional means not shown. The clips 62 are upstanding integral extensions of four spring arms 66 which extend around the periphery of disc-like member 26 and are themselves also integral parts thereof.

The rotatable member 28 is rotatably mounted on the front end of the insulating holder 22. More particularly, rotatable member 28 has a ring of inwardly bent spring clips 68 which engage the hub 34 behind the frusto-conical portion 36, their springiness enabling them to be pushed over the portion 36 on assembly.

Figure 4:
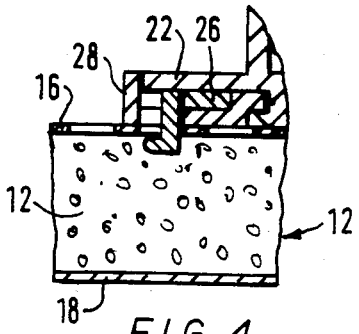
FIG. 4 is a partial view corresponding to FIG. 3 but showing the jack plug unclipped from the distribution bus.
Figure 2:
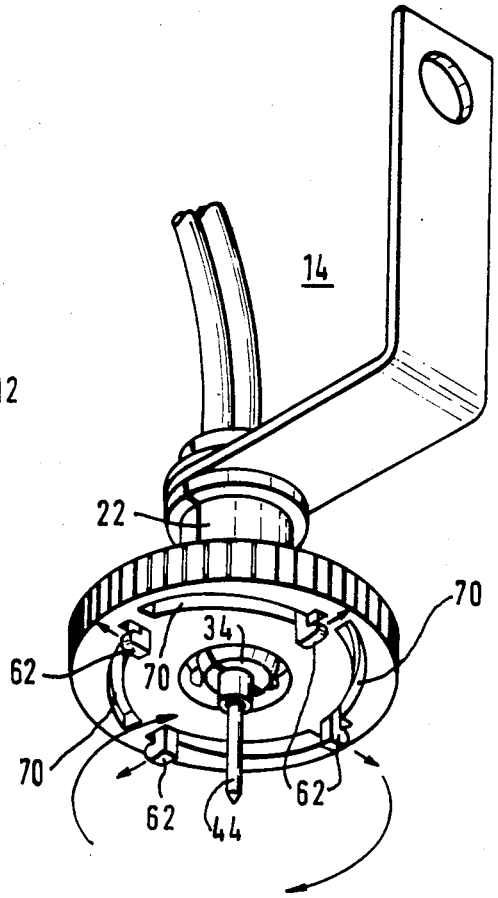
FIG. 2 is a greatly enlarged perspective view of the jack plug of FIG. 1.
Figure 5:
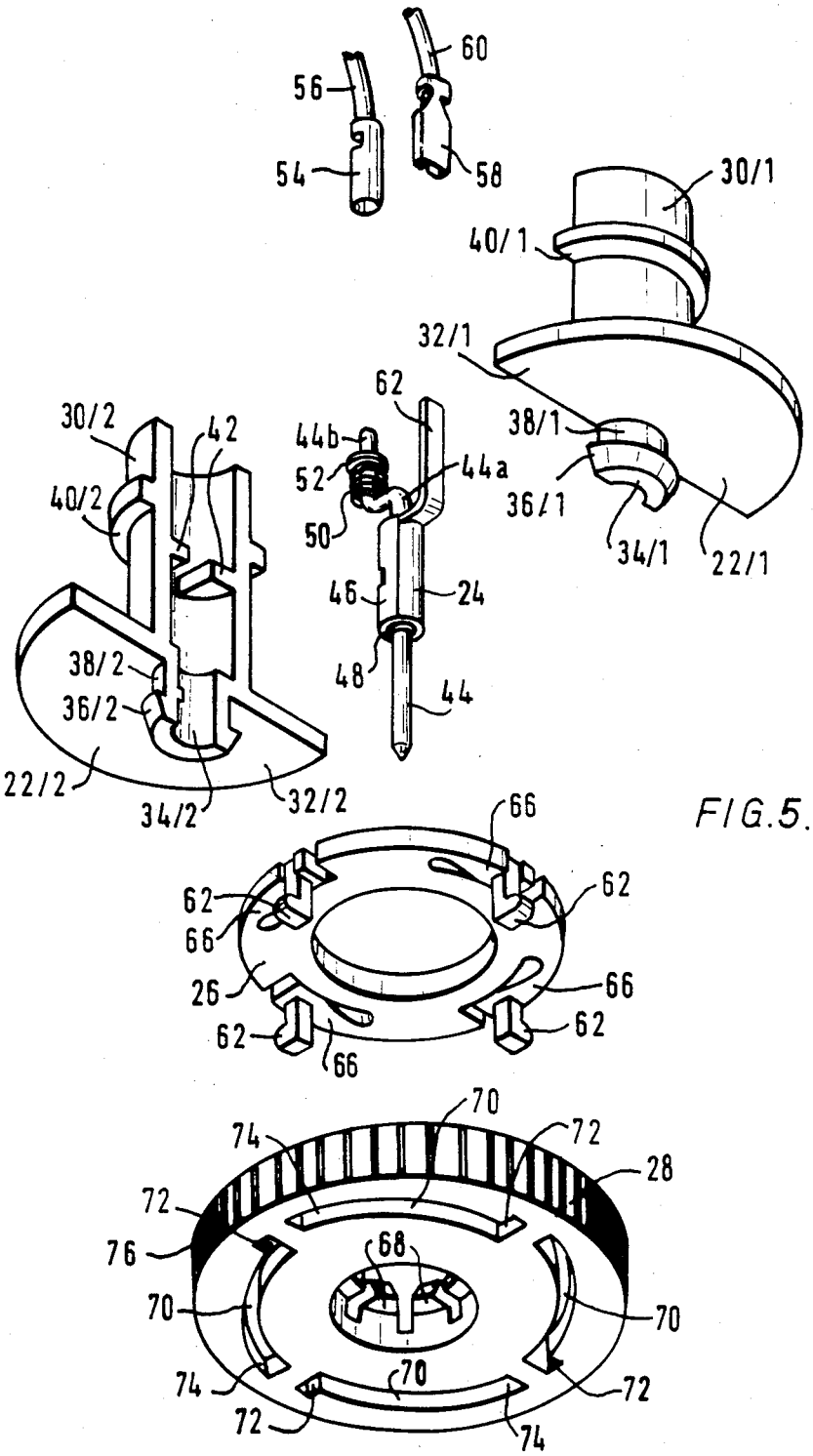
FIG. 5 is an exploded perspective view of the jack plug.

The rotatable member 28 has four arcuate camming slots 70, through which the clips 62 extend. Each slot 70 has one, enlarged end 72 nearer to the central axis of rotation than the other end 74, which is angularly spaced from the first slot end 72 relative to the rotational axis. The natural (i.e. unstressed) positions of clips 62 and arms 66 is as shown in FIG. 5 (and also in FIG. 4), such that the clips 62 can be readily poked through the enlarged inner ends 72 of the slots 70 on assembly. When member 28 is rotated so that the clips 62 relatively slide in slots 70 to the outer ends 72, the clips 62 are cammed radially outwardly to the positions shown in FIG. 3. In these positions, being radially outwardly bent, as shown, the clips 62 engage the rear side of the front conductor sheet 16 as shown. The member 28 has a knurled rim 76.

In use, after the required position for the jack plug 14 on the distribution bus 12 has been chosen, the contact pin 44 is pushed through the appropriate hole 64 in the front conductor sheet 16 and through the insulating sheet 20 to make contact with the rear conductor sheet 18.

Simultaneously, the contact sleeve 46 enters the same hole 64 to make contact with the front conductor sheet 16. Also, the four clips 62 (in their inward positions, see FIGS. 4 and 5) enter four other holes 64.

Then the rotatable member 28 is rotated to cam the clips 62 outwardly to their FIG. 3 positions, to clip the jack plug 14 to the distribution bus 12.

The member 28 can be rotated the other way to unclip the jack plug 14 from the distribution bus 12, so that it can be withdrawn therefrom (possibly for repositioning).

The sleeve 46 is preferably chamfered at its front end to facilitate its insertion into the selected hole 64 in the front conductor sheet 16.

Figure 6:
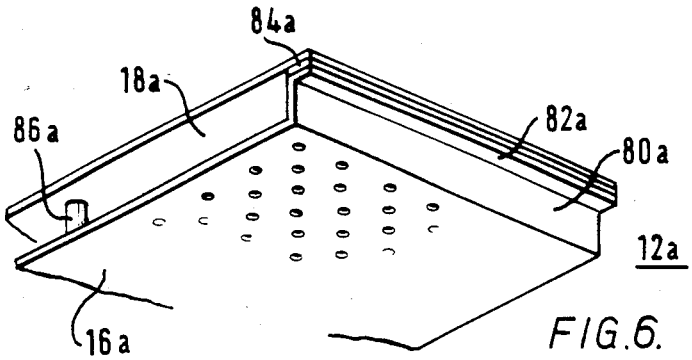
FIGS. 6, 7, 8 and 9 illustrate modified distribution buses.

Referring to FIG. 6, a modified distribution bus **12*a* comprises a front sheet electrode 16*a* and rear sheet electrode 18*a* which are spaced apart over most of their surface areas but with no insulating material in the space, but only air. Sheet electrode 16*a* is stepped along one edge 80*a* and is provided with a lip 82*a* secured to sheet 18*a* via insulating material 84*a*. Away from the edge 80*a* the two sheets 16*a* and 18*a* are spaced apart by posts 86*a*, only one of which is shown. The sheet 18*a* is imperforate, like sheet 18 of distribution bus 12 (FIGS. 1, 3 and 4**).

Figure 7:
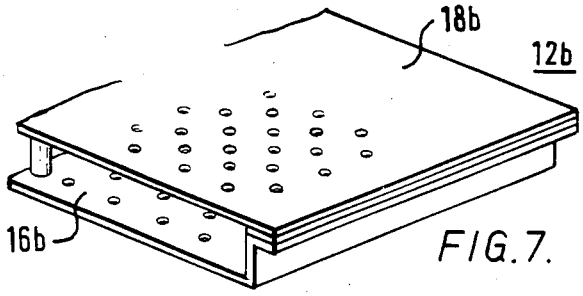

The modified distribution bus **12*b* of FIG. 7 is like the distribution bus 12*a* of FIG. 6, except that the second sheet electrode 18*b*, as well as the first sheet electrode 16*b*, is perforated with holes so that the jack plug (FIGS. 1–5) can be inserted into either sheet 16*b* or sheet 18*b*, that is to say, either side of the distribution bus 12*b*. The holes in sheet 16*b* are out of register with the holes in sheet 18*b***, in order that insertion of the jack plug into either of the two sheets will bring the central contact pin into contact with the metal of the other sheet.

Figure 8:
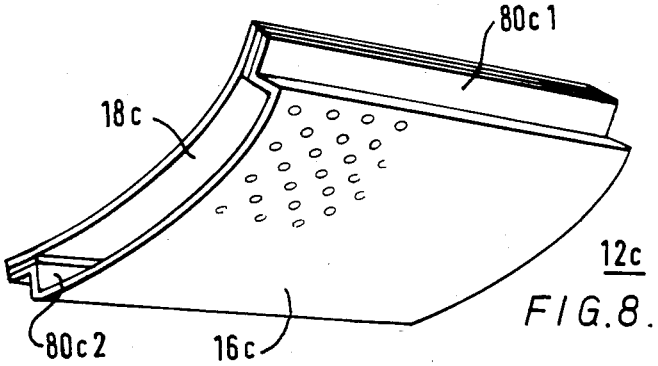

Referring to FIG. 8, the modified distribution bus **12*c* is like distribution bus 12*a* except that the two sheets 16*c* and 18*c* are joined together along opposite side edges 80*c*1 and 80*c*2, with the result that the spacing of the sheets 16*c* and 18*c* does not require posts corresponding to posts 86*a* of FIG. 6**.

Figure 9:
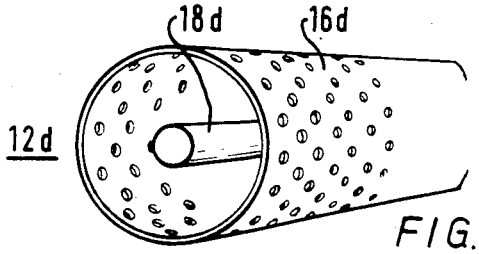

Referring to FIG. 9, the sheet electrode **16*d* of distribution bus 12*d* is cylindrical and surrounds the second electrode, which is in the form of an elongate coaxial rod 18*d*, with means (not shown) supporting the electrode 18*d* coaxially within and electrically insulated from the electrode 16*d***.

In each of the distribution buses **12*a* to 12*d* of FIGS. 6–9, the two electrodes 16*a–d* and 18*a–d* are spaced apart across an air gap, rather than with insulation material in the gap, apart from wherein the electrodes 16*a–c* and 18*a–c* are joined together along one or both edges 80*a–c*. This reduces the cost of each distribution bus 12*a–d* as compared with the distribution bus 12 of FIG. 1, 3 and 4**.

We claim:

1. A low voltage electrical distribution system comprising a distribution bus and a jack plug, the jack plug having an electrical contact assembly, the distribution bus comprising two electrodes supplied or adapted to be supplied with low voltage electricity therebetween, at least one of the electrodes being in the form of a sheet having a substantial number of pre-perforated hole means for receiving the contact assembly of the jack plug, said hole means enabling the contact assembly of the jack plug to be plugged into the distribution bus at selected alternate positions to make electrical contact with both electrodes, and means on the jack plug and coacting with hole means other than the hole means which receive said contact assembly for the purpose of securing said jack plug to said distribution bus.

2. A system as claimed in claim 1 wherein insulating material fills a space between the two electrodes.

3. A system as claimed in claim 1 wherein a space between the two electrodes is air-filled.

4. A system as claimed in claim 1 wherein said sheet is cylindrical and wherein the other electrode is elongate and co-axial with the sheet.

5. A system as claimed in claim 1 wherein the contact assembly of said jack plug comprises a spring-biased contact pin received in, but insulated from, a contact sleeve.

6. A system as claimed in claim 1 wherein the other electrode is in the form of a second sheet parallel to but spaced from the first sheet.

7. A system as claimed in claim 6 wherein the second sheet is pre-perforated with hole means for the contact assembly of the jack plug, the hole means in the second sheet being out of register with the hole means in the first sheet.

8. A system as claimed in claim 6 wherein the second sheet is imperforate.

9. A system as claimed in claim 6 wherein both sheets are planar.

10. A system as claimed in claim 6 wherein both sheets are curved.

11. A system as claimed in claim 1 wherein the jack plug comprises a rotatable member acting upon a plurality of spring clips for making them clip into said hole means.

12. A system as claimed in claim 11 wherein the spring clips are arranged to be cammed by the rotatable member.

13. A system as claimed in claim 12 wherein the spring clips project through cam slots in the rotatable member.

14. A system as claimed in claim 1:

wherein the jack plug is self-securing by clipping into said hole means;

wherein the jack plug comprises a rotatable member acting upon a plurality of spring clips for making them clip into the hole means;

wherein the spring clips are arranged to be cammed by the rotatable member;

and wherein the spring clips project through cam slots in the rotatable member.

15. A system as claimed in claim 14 wherein the contact assembly of the jack plug comprises a spring-biased contact pin received in, but insulated from, a contact sleeve.

16. A system as claimed in claim 14 wherein insulating material fills a space between the two electrodes.

17. A system as claimed in claim 14 wherein a space between the two electrodes is air-filled.

18. A system as claimed in claim 14 wherein said sheet is cylindrical and wherein the other electrode is elongate and co-axial with the sheet.

19. A system as claimed in claim 14 wherein the other electrode is in the form of a second sheet parallel to but spaced from the first sheet.

20. A system as claimed in claim 19 wherein the second sheet is pre-perforated with hole means for the contact assembly of the jack plug, the hole means in the second sheet being out of register with the hole means in the first sheet.

21. A system as claimed in claim 19 wherein the second sheet is imperforate.

22. A system as claimed in claim 19 wherein both sheets are planar.

23. A system as claimed in claim 19 wherein both sheets are curved.

24. A low voltage electrical distribution system comprising a distribution bus and a jack plug, the jack plug having an electrical contact assembly, the distribution bus comprising two electrodes adapted to be supplied with low voltage electricity therebetween, said electrodes comprising a pair of electrically conductive sheets disposed in spaced face-to-face parallel relation with one another, at least one of said sheets being exposed and uncovered on one side and having a substantial number of pre-perforated holes for receiving the contact assembly of the jack plug and for enabling the contact assembly to make electrical contact with the other sheet, said holes enabling the contact assembly of the jack plug to be plugged into the distribution bus at selected alternate positions.

25. A system as defined in claim 24 in which said jack plug includes means coacting with at least one of said holes to releasably secure said jack plug to said distribution bus, said one hole being a hole other than the hole which receives the contact assembly of said jack plug.

* * * * *